US008981924B2

(12) United States Patent
Yaqub et al.

(10) Patent No.: US 8,981,924 B2
(45) Date of Patent: Mar. 17, 2015

(54) SHORT RANGE IP BASED PERSONAL AREA NETWORK FOR PERSONAL POSSESSIONS MANAGEMENT

(75) Inventors: Raziq Yaqub, Stewartsville, NJ (US); Tao Zhang, Fort Lee, NJ (US)

(73) Assignees: Toshiba America Research, Inc., Washington, DC (US); Telcordia Technologies, Inc., Piscataway, NJ (US)

( * ) Notice: Subject to any disclaimer, the term of this patent is extended or adjusted under 35 U.S.C. 154(b) by 699 days.

(21) Appl. No.: 11/934,936

(22) Filed: Nov. 5, 2007

(65) Prior Publication Data

US 2008/0106399 A1 May 8, 2008

Related U.S. Application Data

(60) Provisional application No. 60/864,533, filed on Nov. 6, 2006.

(51) Int. Cl.

| | |
|---|---|
| ***G08B 1/08*** | (2006.01) |
| ***G08B 13/14*** | (2006.01) |
| ***G08B 21/02*** | (2006.01) |
| ***G08B 25/08*** | (2006.01) |

(52) U.S. Cl.

CPC ..... *G08B 13/1427* (2013.01); *G08B 21/0227* (2013.01); *G08B 21/0238* (2013.01); *G08B 21/0269* (2013.01); *G08B 21/0277* (2013.01); *G08B 21/0294* (2013.01); *G08B 25/08* (2013.01)

USPC ..... 340/539.11; 340/539.13; 340/539.21; 340/572.1; 340/572.8; 340/5.1; 340/10.1; 340/568.1; 340/568.6; 340/568.7; 235/375; 235/385

(58) Field of Classification Search

USPC ..... 340/539.11, 5.1, 568.1, 539.13, 539.21, 340/10.1–10.6, 572.1–572.9, 568.6, 568.7; 235/375, 385

See application file for complete search history.

(56) References Cited

U.S. PATENT DOCUMENTS

| | | | | |
|---|---|---|---|---|
| 5,289,163 | A * | 2/1994 | Perez et al. | 340/539.32 |
| 6,297,737 | B1 * | 10/2001 | Irvin | 340/571 |
| 7,049,963 | B2 * | 5/2006 | Waterhouse et al. | 340/572.1 |
| 7,515,901 | B1 * | 4/2009 | Kaundinya | 455/411 |
| 2002/0080036 | A1 * | 6/2002 | Rabanne et al. | 340/573.1 |

(Continued)

OTHER PUBLICATIONS

U.S. Appl. No. 11/379,569, filed Apr. 20, 2006, V. Fajardo.

(Continued)

*Primary Examiner* — Steven Lim
*Assistant Examiner* — Ryan Sherwin
(74) *Attorney, Agent, or Firm* — Westerman, Hattori, Daniels & Adrian, LLP

(57) ABSTRACT

In some embodiments, a personal possession management system using a short range Internet Protocol (IP) based Personal Area Network (PAN) comprises a master device MD to be worn or held by a user, and an IP based RFID electronic tag ET to be attached to or contained within a personal possession desired to be managed. The electronic tag ET has communicability with the master device. The master device MD is configured to allot an IP address to the electronic tag ET in a registration mode using IEEE 802.11 protocols and sends probes to the electronic tag ET. The electronic tag ET is configured to receive messages from the master device MD and respond accordingly. The master device MD alerts a user when the communicability between the master device MD and the electronic tag Er is disrupted in a monitoring mode.

26 Claims, 4 Drawing Sheets

(56) References Cited

U.S. PATENT DOCUMENTS

| | | | | |
|---|---|---|---|---|
| 2002/0126010 | A1* | 9/2002 | Trimble et al. | 340/568.1 |
| 2003/0034887 | A1* | 2/2003 | Crabtree et al. | 340/539 |
| 2003/0063003 | A1* | 4/2003 | Bero et al. | 340/573.1 |
| 2004/0193449 | A1* | 9/2004 | Wildman et al. | 705/2 |
| 2005/0128076 | A1 | 6/2005 | Shinada et al. | |
| 2005/0134459 | A1 | 6/2005 | Glick et al. | |
| 2005/0199716 | A1* | 9/2005 | Shafer et al. | 235/385 |
| 2006/0034282 | A1* | 2/2006 | Hattig | 370/392 |
| 2006/0055564 | A1 | 3/2006 | Olsen et al. | |
| 2006/0062183 | A1 | 3/2006 | Forte et al. | |
| 2007/0013518 | A1* | 1/2007 | Howarth | 340/572.1 |

OTHER PUBLICATIONS

"Keeping Kids Safe in and Around Cars" [homepage on the Internet], Harrison's Hope Nonprofit Organization, USA. Available from: www.harrisonshope.org.

International Preliminary Report, May 22, 2009, pp. 1-8.

Extended European Search Report dated Nov. 30, 2010, issued in corresponding European Patent Application No. 07867370.4.

Canadian Office Action dated Aug. 15, 2012, issued in corresponding Canadian Patent Application No. 2,668,790, (3 pages).

* cited by examiner

SHORT RANGE IP BASED PERSONAL AREA NETWORK FOR PERSONAL POSSESSIONS MANAGEMENT

This application claims priority under 35 U.S.C. §119 to U.S. Provisional Application No. 60/864,533 filed on Nov. 6, 2006, the entire disclosure of which is incorporated herein by reference in its entirety.

BACKGROUND OF THE INVENTION

1. Field of the Invention

The preferred embodiments of the present invention relate, inter alia, to a personal possession management system using a short range IP based Personal Area Network (PAN) and a method for managing personal possessions.

2. Description of the Related Art

The following description sets forth the inventor's knowledge of the related art and problems therein and should not be construed as an admission of knowledge in the prior art.

Portable personal possessions, such as, e.g., brief cases, ladies purses, or cameras, may be easily lost. In some cases, a person may forgetfully leave his/her portable personal possession at public places. Among other things, along with the popularization of a keyless entry system of cars, forgetting kids in a car has also increased tremendously, which is becoming a major concern particularly during extreme weather conditions.

In cases where a person is in an unsafe public space, e.g., a person is traveling in an unsafe public transportation where pick pocketing or theft is a common phenomenon, the person may have his/her portable personal possession stolen or pick pocketed.

In another situation, a person may unknowingly or accidentally loose or drop, e.g. a wallet or the like, from his/her pocket.

To cope with the aforementioned problems, several solutions have been proposed.

U.S. Pat. No. 6,297,737, issued on Oct. 21, 2001, discloses a miss-placed object locating system comprising a "locating unit" and a "locating tag." The locating unit transmits signals to the locating tag fastened with a valuable possession. When the locating tag receives a signal, an audio alarm is sounded (This concept is also used in residential cordless phones to locate a cordless receiver). Additionally, the proposed system is bi-directional enabling the locating tag to send a signal to the locating unit to give an indication that the tagged item is nearby, which is useful when the audio alarm cannot be heard.

U.S. Patent Publication No. 2002/0126010, published on Sep. 12, 2002, discloses an object locator system comprising a "finder" and "tags." Each has a memory, and send/receive capabilities employing radio frequency (RF) signaling and is used for tracking or locating missing objects.

U.S. Patent Publication No. 2003/0034887, published on Feb. 20, 2003, discloses a system comprising a "tracking transceiver" and a "handheld locator". The handheld locator when activated makes the tracking transceiver (attached to an article to be tracked) send back a response about its existence. From the received response, the handheld locator ascertains the distance and/or direction to the tracking transceiver.

U.S. Pat. No. 6,577,238, issued on Jun. 10, 2003, discloses a system comprising a "detector" and an "Radio Frequency Identification (RFID) tag". The detector is configured to detect changes in the range of the RFID tag(s) from the detector. If the range exceeds a predetermined threshold, the detector triggers an alarm. The range may be determined by measuring (a) the round trip time of the radio signal from the tag, (b) the signal strength of the returned radio signal from the tag, or (c) the changes in a periodic interval at which a signal is transmitted by the tag.

U.S. Patent Publication No. 2002/0080036, published on Jun. 27, 2002, discloses a system comprising a "parent unit" and a "child unit". Both units are each equipped with a transceiver and a Global Positioning System (GPS) receiver. The child unit receives a control signal and sends a locator signal. The parent unit has a processor and can determine the position (relative direction and distance) of the child unit.

U.S. Patent Publication No. 2002/0145520, published on Oct. 10, 2002, discloses a system comprising a "RFID tag" and a "receptacle with an antenna" for monitoring storage units, i.e., for tracking the removal and insertion of objects from the storage unit. The RFID tag is attached to an object to be tracked and the receptacle is housed in the storage unit. Each receptacle activates the RFID tag of the object placed in the receptacle.

U.S. Pat. No. 5,289,163, issued on Feb. 22, 1994, discloses a system comprising a "transmitter," a "detector" (attached to a child) and a device that monitors the position of the child by detecting the signal strength of a radio frequency carrier from the transmitter attached to the child. If the radio signal is too weak, an alarm notifies the adult that the child is too far away.

U.S. Patent Publication No. 2003/0063003, published on Apr. 3, 2003, and U.S. Patent Publication No. 20050134459, published on Jun. 23, 2005 discloses a loss prevention system to prevent articles from becoming lost. The system comprises a "monitor" and "RFID tags". The monitor broadcasts a signal to all of the tags and receives the responses from all and generates if it does not receive an alarm form any of the RFID tags. Since the signal is broadcasted to all the RFID devices, the responses are also expected to come from all at the same time and thus there are chances of collision. To overcome this problem, the patent also proposes a collision avoidance circuitry.

European Patent Application No. 1,288,878, published on Mar. 5, 2003, discloses a system comprising a "base station" and "RFID security tags". The base station comprises a control unit and an RF transceiver. The control unit sends a monitoring signal that is received by the RFID tag. The RFID tag is inductively powered by the monitoring signal and responds with an identity signal. Because of the limited range of the monitoring signal and the identity signal, removal of the RFID security tag from the proximity of the base station causes the identity signal not to be received by the base station. Thus, when the base station sends a monitoring signal but no identity signal is received in response, an alarm is sounded.

Although the aforementioned conventional techniques may be useful to manage personal possessions in some instances, instead of locating an article after it is lost, it is preferable in many circumstances to prevent the personal portable possessions from being lost, pick-pocketed, stolen, misplaced, or left behind accidentally or forgetfully. Thus, a reliable, and state of the art system is needed to help in preventing the personal possessions from being lost.

For background reference, the following background references are incorporated herein by reference in their entireties.

[1]. 802.11 Working Group Web site.

[2]. The entire disclosure of the following U.S. patent application is Incorporated herein by reference as though recited herein in full: U.S. patent application Ser. No. 11/379,569, filed on Apr. 20, 2006, entitled Fast Link-Down Detection Systems and Methods, to V. Fajardo, et al.

[3]. KIDSINCARS Web Site.

[4]. "IEEE 802.11b, Part 11 Wireless LAN Media Access Control (MAC) and Physical Layer (PHY) specification", IEEE-SA Standard Board, 1999.

[5]. "IEEE 802.11g, Part 11 Wireless LAN Media Access Control (MAC) and Physical Layer (PHY) specification", IEEE-SA Standard Board, 2003.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments can provide a personal possession management system using a short range Internet Protocol (IP) based Personal Area Network (PAN) capable of watching and tracking of personal possessions on move or at rest.

Among other potential advantages, some embodiments can provide a personal possession management system using a short range Internet Protocol (IP) based Personal Area Network (PAN) capable of communicating and forwarding desired information to authorized supplementary devices possessed by the same user to facilitate user interaction with.

According to a first aspect of a preferred embodiment of the present invention, a personal possession management system using a short range Internet Protocol (IP) based Personal Area Network (PAN), comprising:

a master device to be worn or held by a user; and an IP based RFID electronic tag to be attached to or contained within a personal possession desired to be managed, the electronic tag having communicability with the master device, wherein the master device is configured to allot an IP address to the electronic tag in a registration mode using IEEE 802.11 protocols and sends probes to the electronic tag, wherein the electronic tag is configured to receive messages from the master device and respond accordingly, and wherein the master device alerts a user when the communicability between the master device and the electronic tag is disrupted in a monitoring mode.

The master device preferably comprises a vibrator for warning the user when the communicability is disrupted in the monitoring mode.

In place of the vibrator, the master device can comprises a beeper for warning the user when the communicability is disrupted in the monitoring mode.

It is preferable that the master device has a screen for displaying a name of the electronic tag ET so that the name of the electronic tag displayed on the screen and coupled with the warning helps the user to take necessary actions.

The master device can be an active, battery operated portable device capable of being carried or worn by a user.

The master device can comprise a short range network interface for carrying out basic communication with the activated electronic tag, an active register for keeping record of the electronic tag, a legacy register for keeping record of deactivated electronic tag, a dynamic host configuration protocol (DHCP) server for dynamically providing an IP address and configuration information to the electronic tag, a beeper/vibrator for warning the user through audible alarm, a user interface for facilitating the user to operate the master device, and the electronic tag comprises a short range NLOS radio network interface for carrying out communication with the master device and a register for storing information.

The master device can further comprise a Blue tooth module configured to communicated with a supplemental device.

The short range network interface can comprise a receiver, a transmitter, an antenna, to carry out basic communication with the electronic tag in the registration mode and the monitoring mode.

In the personal possession management system, the electronic tag can be an active, low powered battery operated device.

The electronic tag can comprise a low rate short range NLOS radio network interface for carrying out communication with the master device and a register for storing information including an IP address allocated by the master device and credentials associated to the IP address.

According to the second aspect of a preferred embodiment of the present invention, a method of managing a personal possession using a short range Internet Protocol (IP) based Personal Area Network (PAN), comprises:

preparing a master device to be worn or held by a user and one or a plurality of IP based RFID electronic tags each configured to be attached to or contained within a personal possession to be managed, each of the electronic tags having communicability with the master device;

attaching each electronic tags to a personal possession to be managed;

activating both the master device and the electronic tags;

operating the master device in a registration mode to perform registration procedures with the activated electronic tags present in a radio jurisdiction of the master device in a registration mode, the registration procedures including acquiring credential of each electronic tag and allotting an IP address to each electronic tag using IEEE 802.11 protocols;

turning on the master device to a monitoring mode to perform surveillance duties governed by Active Scanning Algorithm.

The description herein of advantages and disadvantages of various features, embodiments, methods, and apparatus disclosed in other publications is in no way intended to limit the present invention. For example, certain features of the preferred embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Figure 1:
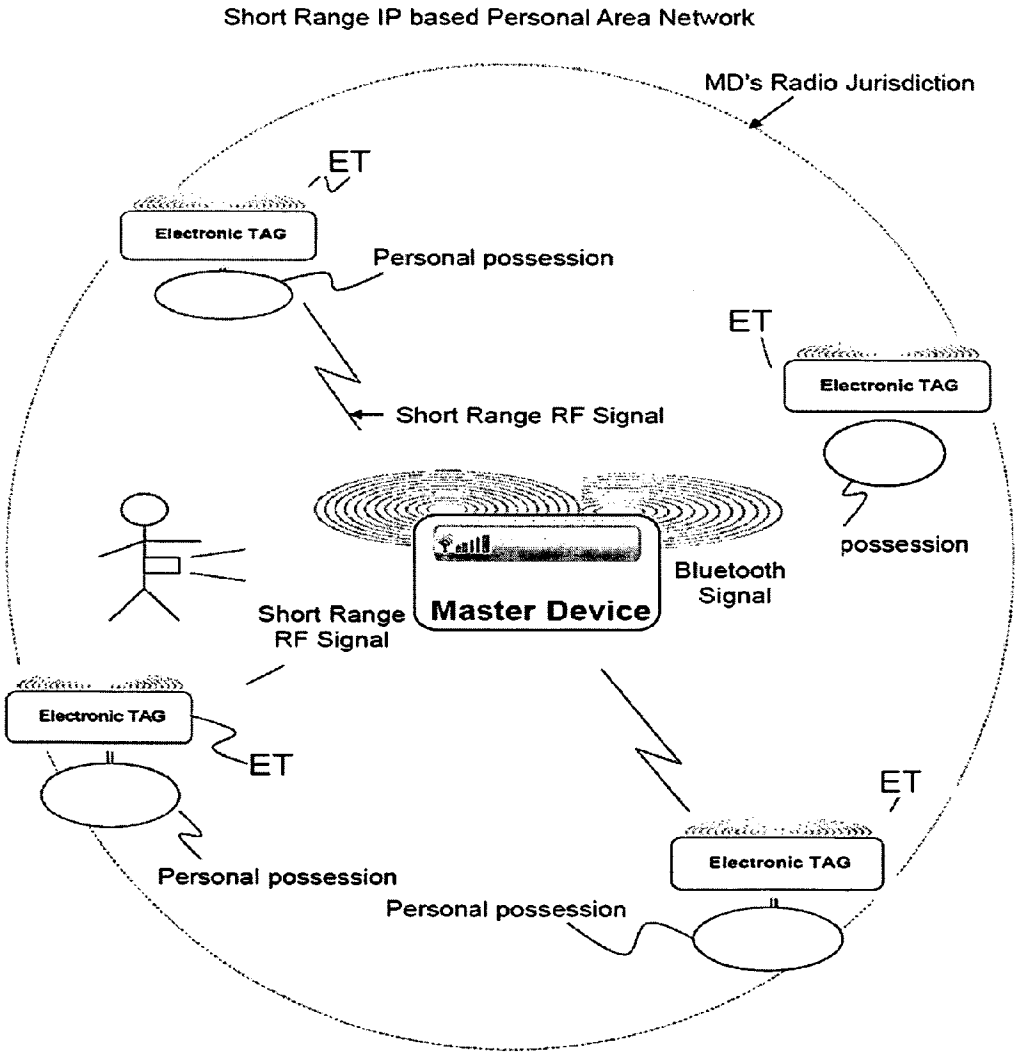
FIG. 1 is a schematic view showing a personal possession management system according to some embodiments of the present Invention.

Hereinafter, some preferred embodiments of a personal possession management (hereinafter referred to as "PPM") system using a short range Internet Protocol (IP) based Personal Area Network (PAN) according to the present invention will be explained. As shown in FIG. 1, this PPM system uses a short range IP based Personal Area Network (PAN) and includes a master device MD and one or a plurality of IP based Radio Frequency Identification (RFID) Electronic Tags (also referred to as, e.g., "electronic tag" or ET) as main structural elements. In the preferred embodiments, the master device MD is configured to be carried or worn by a user. The electronic tag ET can preferably be attached to, or contained within, a personal possession, such as, e.g., a briefcase, a camera, a wallet, a purse, a bag, or even upon an animal, pet or a child, to be monitored, e.g., to be saved from, e.g., being lost, stolen, pick pocketed, misplaced, or left behind accidentally or forgetfully.

According to a personal possession management (PPM) system of one of preferred embodiments, in normal operations, the electronic tags ET currently associated with the master device MD and attached to, or contained within, a personal possession has communicability with the master device MD which can be, e.g., carried by the user. If the communicability is disrupted due to, e.g., unanticipated movement of the personal possession having the electronic tag Er from the radio jurisdiction of the master device MD, such disruption event will be detected by the master device MD and the disruption indication will be quickly propagated to the master device MD so that the master device MD can, e.g., beep and/or vibrate to notify the user of the unanticipated movement of the personal possession. This is representative of the fact that the electronic tag ET attached to, or contained within, the personal possession is going out of a predetermined range (e.g., the possession is going to be left behind accidentally or forgetfully or going to be lost or stolen). Accordingly, a beep and/or vibration or the like of the master device MD gives the user a warning. In cases where the master device MD has a screen for displaying the name of the electronic tag ET, the displayed name of the electronic tag Er coupled with the beep and/or vibration or the like can help the user to take necessary actions.

In some preferred embodiments, the personal possession management (PPM) system (a) allows watching and tracking of personal possessions during movement or at rest, (b) uses IP based state of art 802.11 technology coupled with an Active Scanning Algorithm specifically tailored for this application in a "Registration Mode" and a "Monitoring Mode," respectively, (c) is capable of addressing needs of each electronic tag ET in a group individually either in a rational order or according to some preferred scheduling giving priority to those electronic tags ET that have high sensitivity (e.g., the electronic tags ET associated with more valuable or pricy possessions) according to user preferences, (d) is capable of addressing each electronic tag ET in a group individually according to a status selected by the user, e.g.: "Watch Status", for preventing the personal possessions from being lost; "Hunt Status", for tracking the misplaced personal possessions; and "Wait Status", and/or (e) is capable of communicating and forwarding the desired information, over, e.g., a BLUETOOTH link, to authorized supplementary devices (such as, e.g., a personal digital assistant (PDA), a Cellular Phone, a lap top computer, etc.) possessed by the user to facilitate the user's interaction with the master device MD. Thus, the personal possessions management system (PPM) using a short range IP based Personal Network (PAN) according to preferred embodiments of the present invention can overcome the limitations of conventional Radio Frequency Identification (RFID) readers.

Conventional RFID readers can occasionally fail to read a tag because of interference from other objects, especially human bodies with their high water content that absorbs RF energy. In the personal possession management system (PPM) using a short range IP based Personal Network (PAN) according to some preferred embodiments of the present invention, the IP based RFID electronic tags ET can implement security and authentication policies. They can ensure that information is protected and only shared with authentic client(s). They can also be made to report additional and vital information. Furthermore, in preferred embodiments, the IP based RFID electronic tag Er has an IP address and can also be enabled to report its location/information to a user's preconfigured website.

The Short Range IP based Personal Area Network (PAN) for the Personal Possessions Management (PPM) provides improved elements and new arrangements to accomplish the intended purposes. In the preferred embodiments, the master device MD is fundamentally a monitoring device that allots an IP address to the electronic tags ET in a "Registration Mode" using, e.g., IEEE 802.11 protocols used for associating 802.11 Stations with IEEE 802.11 Access Points, and sends probes to the electronic tags ET in a "Monitoring Mode" using, e.g., the Active Scan Algorithm (ASA) adapted for this application. The electronic tag ET is fundamentally a device that receives messages from the master device MD and responds accordingly. The electronic tags ET are attached to, or contained within, those personal possessions that are desired to be managed, e.g., saved from being lost, pick pocketed, misplace, or left behind accidentally or forgetfully.

Figure 2:
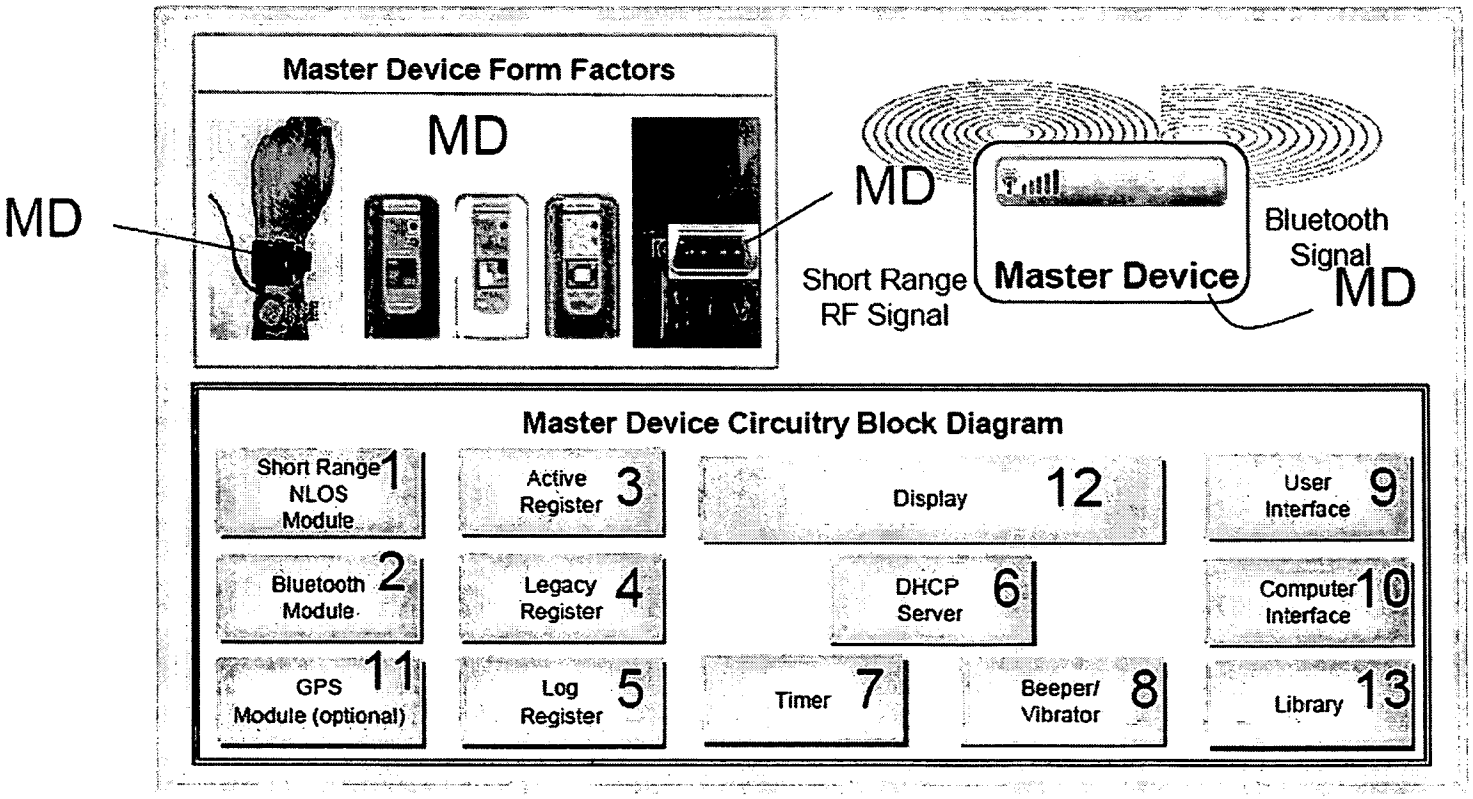
FIG. 2 shows various types of master devices and a block diagram thereof employed in the personal possession management system.

Master Device (MD):

FIG. 2 shows some illustrative examples of master devices MD. As shown in FIG. 2, the master device MD is preferably, but not limited to, an active, battery operated, small, and portable device capable of being carried or worn by a user. The master device MD can take various different form factors (i.e., can have a variety of forms) as shown in FIG. 2. However, the functions of these form factors are preferably substantially the same. By way of example, as shown in FIG. 2, the master device can include a strap for mounting on one's body (such as, e.g., one's wrist like a watch), can be formed as a small portable device (such as, e.g., sized similar to a common PDA or cell phone or the like as shown (adjacent the wrist-watch-type example), can include a belt or a mechanism (such as, e.g., a clip) to attach to one's belt (such as, e.g., shown in the example at the right of the illustrative form factors shown). In some embodiments, the master device includes a computer processor, digital data storage, memory and a transceiver for wireless communications. In some preferred embodiments, the master device MD has electronic circuitry for, e.g., a short range NLOS (Non Line of Sight) radio module 1, a BLUETOOTH module 2, an active register 3, a legacy register 4, a log register 5, a dynamic host configuration protocol (DHCP) server 6, a timer 7, a beeper/vibrator 8, a user interface, a computer interface 10, a GPS module 11, an On/Off switch, and a display 12 and a library 13.

In a preferred embodiment, the short range NLOS radio module 1 includes a short range network interface card including a receiver, a transmitter, an antenna, etc., to carry out basic communication with the electronic tags ET in two distinct modes, i.e., a "Registration Mode" and a "Monitoring Mode," which will be described later.

The Bluetooth module 2 is preferably configured to communicate with various supplementary devices. For example, the master device MD can send messages meant for a user to be displayed on a secondary device (e.g., a BLUETOOTH enabled cellular phone or a personal digital assistant (PDA)). This feature can not only save the battery of the master device MD but can also facilitate the user to read the display 12 without pulling out the master device MD which may be worn with his body at more secure place (such as, e.g., upon the user's belt or within a pocket, etc.). The feature can be enabled based on user preference. This feature requires registration of a secondary device with the master device MD by the user, and availability of the authorized secondary device in the vicinity of the master device MD. Preferably, if any of the conditions is not met, the feature will automatically be disabled.

Preferably, an active register 3 keeps record of each active electronic tag ET to be monitored. It can include the record of IP addresses allocated by the master device MD to the active electronic tags Er mapped with the electronic tag Er credentials acquired by the master device MD during a registration mode, which will be explained later. It can also perform several other background jobs, such as, e.g., managing the electronic tags ET, setting and/or keeping the probing schedules according to the electronic tags' credentials.

Preferably, the legacy register 4 keeps a record of deactivated electronic tags ET. Preferably, when the electronic tag ET is deactivated/deregistered by turning the electronic tag ET off, the record kept by the active register 3 is transferred to the legacy register 4. Later on, this record can be used to track the misplaced articles (e.g., personal possessions) in a "Hunt Status" which will be explained later. At the time of deregistration, the master device MD will preferably expire the lease time of the allotted IP address, associate the "OFF Status" to it and consequently will exclude it from the probing schedule.

Preferably, the log register 5 records the user's behavior regarding forgetfulness or theft alerts mapped duly time stamped. Thus, each time the beeper rings to alarm the user about possible theft, or loss, it preferably records the incidents. This incident record can be accessed by the user for his personal use for taking any precautionary steps for improving his behaviors or attitudes.

Preferably, the dynamic host configuration protocol (DHCP) server 6 is used to dynamically provide IP addresses and configuration information to the electronic tags ET. The DHCP server provides greater flexibility by leasing out IP addresses to active nodes. When a DHCP client (e.g., electronic tag ET) is first switched on, it preferably sends a broadcast packet with a DHCP request. This is picked up by a DHCP server 6, which allocates an IP address to the electronic tag ET, from the pool(s) of addresses it has available. However, the DHCP Server 6 preferably doesn't allocate the address permanently. It preferably tells the electronic tag ET that it has "leased" the address to it for a specific time period. When the lease expires, the electronic tag ET can ask the server 6 to renew the lease. When the electronic tag ET obtains a lease on an address, it is preferably configured so as to know how long the lease period is. In this manner, it is configured to know that it can use the address without reference to the DHCP server 6 until the lease expires. When it does expire, it can request a renewal.

Preferably, the timer 7 is used for carrying out several timed functions including sending reminders for the user as in a "Wait Status" which will be explained later.

Preferably, the beeper and/or vibrator 8 is used to warn the user through audible or other alarms.

Preferably, the user interface 9 facilitates the user to operate the master device MD.

Preferably, the computer interface 10 is used to connect the master device MD with a computer (e.g., including common computer components, such as, e.g., a processor, digital data storage, memory, etc.) for creating new or managing existing applications. In some examples, it can also be used for charging the master device MD from a computer.

Preferably, the library 13 can contain functions and routines for creating new/future applications.

Preferably, a GPS module 11, which is optional in some preferred embodiments, can also be installed in the master device MD so as to be capable of providing location based services.

Preferably, the master device MD has an ON/OFF switch (not shown) for turning on/off the master device MD. In some examples, performing the OFF operation can require user confirmation that can be, e.g., in the form of a password or a PIN number, or any other means (such as, e.g., double pressing of the switch within a specified time duration, etc.). This would avoid a malicious or accidental switch-off of the master device MD. Preferably, even if the master device MD is turned off, the contents of the memories will not be lost.

In the preferred embodiments, the master device MD has two operation modes, i.e., (a) a Registration Mode (RM) and (b) a Monitoring Mode (MM). Each mode will be explained below.

Registration Mode (RM):

Preferably, if the master device MD is chosen to operate in the "Registration Mode (RM)", it performs registration procedures one by one with each turned ON electronic tag ET present in the radio jurisdiction of the master device MD. According to the preferred registration procedure, the master device MD acquires the credential of the electronic tag Er to be registered, allots an IP address to it, associates a "Watch Status" (see below) to it by default, and consequently includes it in a probing schedule as per information acquired from the electronic tag ET.

Thus, the registration process will lead to the association of the electronic tag ET with the master device MD. The association of the electronic tag ET with the master device MD is preferably governed by the well established IEEE 802.11 protocols adapted for this application (i.e., the electronic tag ET will preferably become associated with the master device MD in the same way as 802.11 stations become associated with an 802.11 access point, except the authentication that it will be performed by the user himself, instead of an AAA Server). In some embodiments, a plurality of electronic tags ET can be registered and appended to different possessions. (Thus, an electronic tag ET and the master device MD are analogous to an 802.11 station and an access point, respectively, and an AAA server is analogous to the user himself).

The 802.11 standard defines various frame types that stations use for communications, as well as managing and controlling the wireless link. Every frame has a control field that depicts the 802.11 protocol version, frame type, and various indicators, such as whether WEP is on, whether power management is active, and so on. In addition, according to such standard, all frames contain MAC addresses of the source and destination station, a frame sequence number, frame body and frame check sequence (e.g., for error detection).

802.11 data frames carry protocols and data from higher layers within the frame body. Other frames that stations use for management and control carry specific information regarding the wireless link in the frame body. For example, a beacon's frame body contains a service set identifier (SSID), a timestamp, and other pertinent information regarding the access point.

802.11 management frames enable stations to establish and maintain communications. The following are some of the common 802.11 management frame subtypes:

Authentication frame: 802.11 authentication is a process whereby the access point either accepts or rejects the identity of a radio Network Interface Card (NIC).

Deauthentication frame: A station sends a deauthentication frame if it wishes to terminate secure communications.

Association request frame: 802.11 association enables the access point to allocate resources for and to synchronize with a radio NIC. A NIC begins the association process by sending an association request to an access point. This frame carries information about the NIC (e.g., supported data rates) and the SSID of the network it wishes to associate with. After receiving the association request, the access point considers associating with the NIC, and (if accepted) reserves memory space and establishes an association ID for the NIC.

Association response frame: An access point sends an association response frame containing an acceptance or rejection notice to the radio NIC requesting association. If the access point accepts the radio NIC, the frame includes information regarding the association, such as, e.g., association ID and supported data rates. If the outcome of the association is positive, the radio NIC can utilize the access point to communicate with other NICs on the network and systems on the distribution (e.g., Ethernet) side of the access point.

Disassociation frame: A station sends a disassociation frame if it wishes to terminate the association. For example, a radio NIC that is shut down gracefully can send a disassociation frame to alert the access point that the NIC is powering off. The access point can then relinquish memory allocations and remove the radio NIC from the association table.

For more details regarding 802.11 frame structure and usage, reference is made to the 802.11 standard.

Monitoring Mode (MM):

When the master device MD is turned on to a Monitoring Mode, it stops further registration and switches to perform surveillance duties. Preferably, surveillance is governed by an Active Scanning Algorithm adapted for this application. Preferably, the algorithm repeatedly at regular intervals of time sends Probe Requests to the registered electronic tags ET for verifying communicability with the electronic tags ET. The Probe Requests can be sent either in a rational fashion, or according to some preferred scheduling thereby giving priority to certain electronic tags ET in compliance to the credentials associated with the electronic tags ET. For example, those electronic tags ET that have high sensitivity according to the user preferences can be more frequently scanned in contrast to those electronic tags ET that have low sensitivity.

Preferably, an active scan is deemed to have failed if the number of transmissions reaches certain threshold and no probe response has been received in an expected time interval. In this regard, the link is deemed to be disrupted when active scan fails. Disruption of link is an indication that registered electronic tag ET (e.g., fastened or otherwise located with certain personal possession) is probably going out of range (e.g., left behind, or is prone to be lost). Preferably, this would trigger the beeper or the like, and the name of the electronic tag ET (i.e., that failed to respond) would also be displayed on the screen of the master device MD or forwarded to a supplementary device. As a result, this can help the user to take necessary actions.

The Active Scan Algorithm can use MAC layer functions to establish a reasonable level of communicability with the master device MD provided that (a) the electronic tags ET are already successfully registered (associated) with the master device MD, (b) the electronic tags ET are capable of sending/receiving control and data frames, and (c) during the registration phase, the electronic tags ET and master device MD exchange configuration variables (see, e.g., references 4 and 5 cited above for reference).

In the preferred embodiments, the transmit power of the master device MD will be governed according to the electronic tag's ET credential as explained above. Deactivation (disassociation) process will disable the Active Scanning Algorithm.

Figure 3:
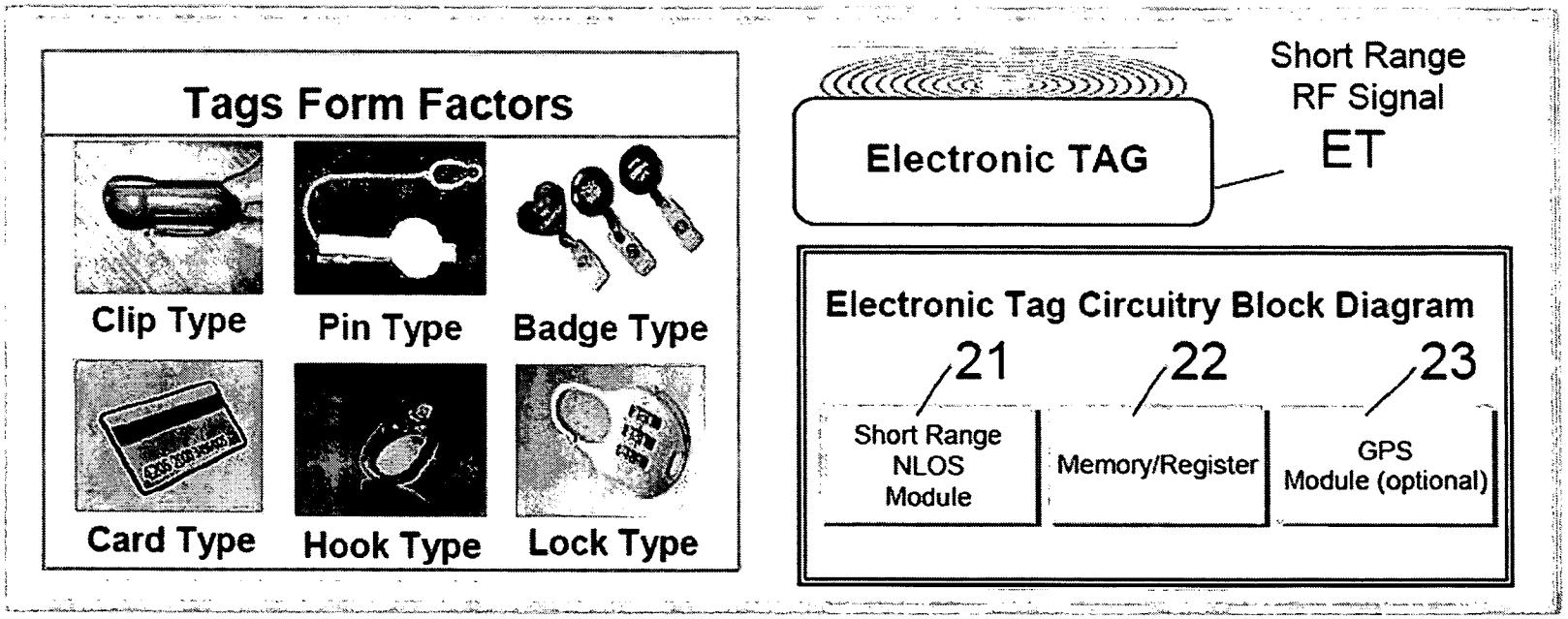
FIG. 3 shows various types of electronic tags and a block diagram thereof employed in the personal possession management system.

Electronic Tag (ET):

In the preferred embodiments, the electronic tags ET are IP based RFID tags that are preferably, but not limited to, active, low powered battery operated devices so that they may communicate with the master device MD. The electronic tags ET can be provided in a plurality of different form factors (i.e., forms) as shown in FIG. 3. By way of example, as shown, the electronic tags can be configured such as to, e.g., include a clip to attach to clothing or another article (see, e.g., clip type form factor shown), can include a pin to attach to clothing or another article (see, e.g., pin type form factor shown), can be configured similar to a badge to be adorned upon a user (see, e.g., badge type form factor shown), can be configured similar to a common credit card in shape (or slightly wider to accommodate circuitry and components) (see, e.g., card type form factor shown), can be configured to include a hook or clamp to attach to clothing or another article (see, e.g., hook type form factor shown), can be configured so as to include a lock to more fixedly attach to an article, to clothing or the like for security purposes (see, e.g., lock type form factor shown). In some embodiments, e.g., the electronic tags ET can include, e.g., a processor, digital data storage, memory, and a transceiver for wireless communications as described herein, all of which can be mounted within a device having one of the noted or other form factors.

However, regardless of the form, its functions are substantially the same. FIG. 3 also shows an illustrative example of a block diagram of an electronic tag ET that contains only two modules 21 and 22, such as to, e.g., to keep it simple and light weight. One module represents low rate short range NLOS radio network interface 21 with all necessary circuitry to carry out communication with the master device MD. The second module is a register/memory 22 where an electronic tag ET can store the essential information such as, e.g., the IP address allocated to it, and the following credentials associated to it (which it, e.g., conveys to the master device MD during the aforementioned Registration Mode).

Name: Name of the electronic tag ET could be, e.g., related to: (a) PET (Pocket Electronic Tag), indicative of the form factor suitable for attaching to the possessions kept in a pocket, such as, e.g., a PDA, or a cellular phone, etc.; (b) WET (Wallet Electronic Tag), indicative of form factor suitable for keeping it in wallet), (c) HET (Hand-carry Electronic Tag), indicative of a form factor suitable for Hand-carry items, such as, e.g., Handbags, Briefcases, Computer bags, etc. The naming could also be in terms of value or importance (such as, e.g., Diamond, Platinum, Gold, and Silver, etc.) based on the value or importance of the item. Regardless of whatever naming conventions are used, a name is preferably representative of an entity to identify the electronic tag ET to the user, so that if an electronic tag ET goes beyond a coverage area, the user could identify it from the name shown on the display 12 (and, thus, identify his personal possession).

Range: In addition to displaying the names of electronic tags ET (e.g., for example PET, WET, and HET) for user's convenience, each electronic tag ET can have different performance parameters associated with its naming convention. For example, the PET and WET may have Low Communication Range, whereas HET may have a comparatively larger range. The range can vary from a few inches to a few meters. The significance of this parameter is that an electronic tag ET associated with a wallet must trigger the alarm if the wallet falls from the user's pocket, whereas an electronic tag ET associated with a hand carry item (such as, e.g., a computer bag, a briefcase, or an unattended child in a car, etc.) must trigger the alarm when the possession has been left behind for a relatively larger distance. Since Transmit Power of an electronic tag ET is a function of desired tracking range, lower transmit power will ensure a longer battery life for PET and HET type of ETs.

Sensitivity: Each electronic tag ET can have a different sensitivity associated with it. For example, the electronic tags ET associated with more pricy and valuable possessions (e.g., personal laptop computers, etc.,) can be scheduled by the master device MD to be probed more frequently to assure the loss prevention. Whereas the electronic tags ET associated with less pricy possessions (such as, e.g., umbrellas, etc.) can be scheduled by the master device MD to be probed less frequently. Since battery consumption of an electronic tag ET is a function of desired sensitivity, a lower sensitivity electronic tag ET will have a longer battery life.

The above noted credentials are functions of threshold distance, sensitivity and some user's preferences. However, provisions can be reserved in the message format that may lead to enhanced quality, improved performance, increased user satisfaction, or that may contribute to make the electronic tag ET and the master device MD smarter in future.

In some preferred embodiments, in addition to sending the probe responses, electronic tags ET can also generate and send additional messages. Those messages can also be meant for the user, such as, providing, e.g., a low battery warning, etc.

In some embodiments, turning the electronic tag ET OFF deregisters the electronic tag ET from the master device MD; nevertheless, in some examples, a PIN (Personal Identification Number) can be required to avoid accidental or malicious deregistration of any electronic tag ET. For example, entering a PIN to turn the electronic tag ET off can automatically send a deactivation message to the master device MD that would gracefully deregister the electronic tag ET. The master device MD on deregistration of an electronic tag ET will move its credentials from the Active Register to the Legacy Register and will no longer be probed by the master device MD.

The preferred embodiments of this invention further enable the user have the master device MD assign different statuses to the electronic tags ET, such as, e.g., "Watch Status", for preventing the personal possessions from being lost, "Hunt Status", for tracking the misplaced personal possessions, and "Wait Status", for silent surveillance and reminders. The following section explains some of the statuses that the master device MD can assign to electronic tags ET.

Figure 4:
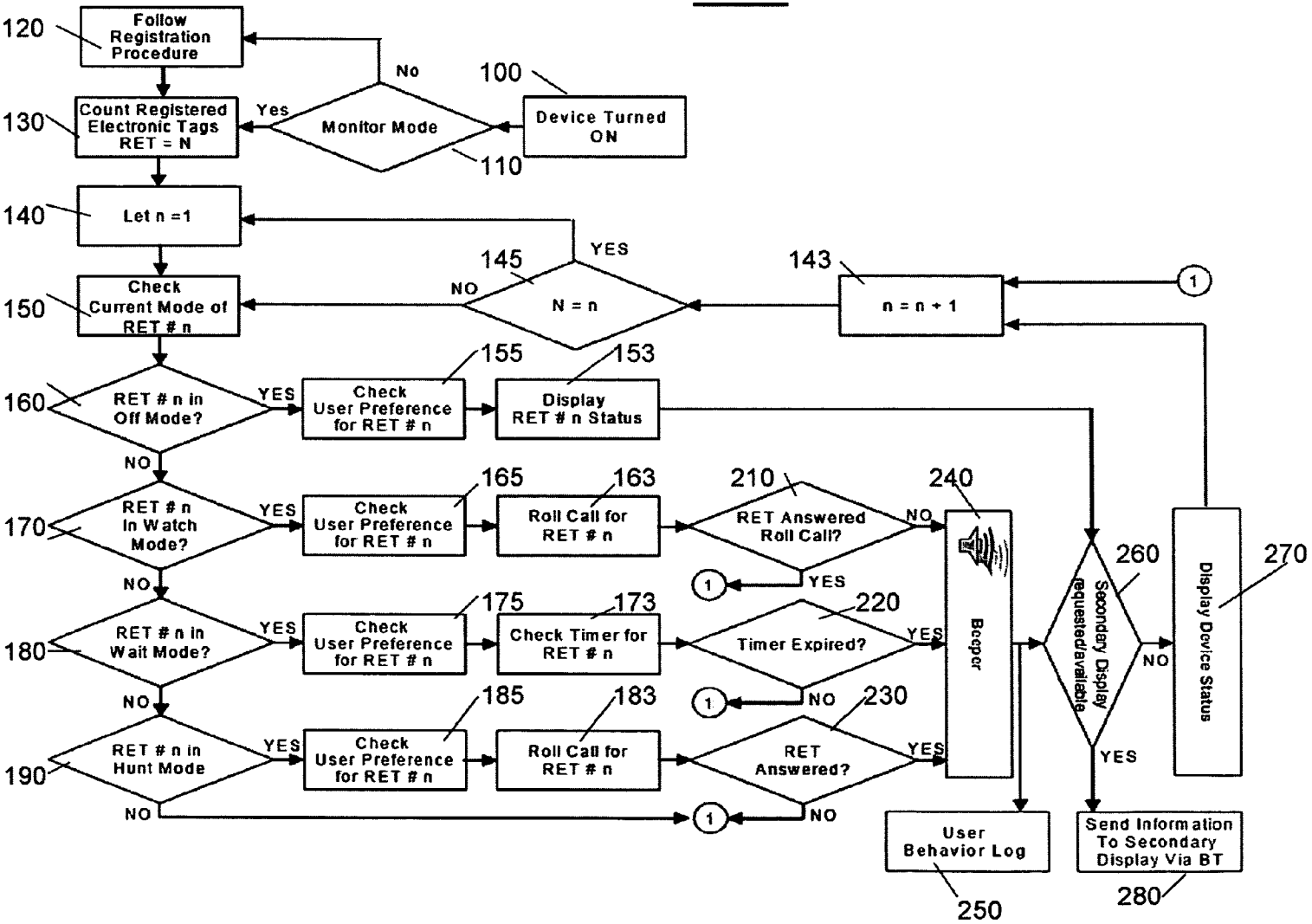
FIG. 4 is a flow diagram of the master device in an operation mode.

List of Statuses that can be Assigned to Electronic Tags ET:

In some embodiments, the user can have the master device MD assign diverse statuses to the electronic tags ET as described below. Preferably, the master device MD can check the status of each electronic tag ET and can deliver the service according to the electronic tag Er status simultaneously (see, e.g., FIG. 4). The "Simultaneous Operation" is illustrated in FIG. 4 which shows, e.g., that the master device MD can perform all the duties related to the following statuses simultaneously.

Watch Status:

Preferably, "Watch" is a default Status. In the Watch Status, the master device MD will watch the activated electronic tags ET as portrayed in the flow diagram shown in FIG. 4. Thus, in this status, if the electronic tag ET goes out of a range, the master device MD will beep or the like and show the name of the electronic tag ET on the display 12.

Wait Status:

In the Wait Status, the master device MD will temporarily stop watching (sending active probes) the activated electronic tags ET for the specified time (e.g., which time can be inputted by a user) as shown in the flow diagram in FIG. 4. Thus, in this status, at the elapse of defined time, the master device MD will beep or the like and show the name of the electronic tag ET on the display 12 also indicating that defined wait period is expired. In some embodiments, it can also display an option for extending the wait time. This Status would be useful if a user in a trustworthy environment, such as, e.g., within a meeting room of a visiting office leaves his possession(s) (e.g., umbrella, bag, briefcase, etc.) unattended in the room for a short duration of time (e.g., to take coffee break or to go to the rest room). This will eliminate the chance of the user forgetting the possession in the visiting office because in the wait status the master device MD will beep or the like to remind the user of his possessions so that he does not forget to take them.

Hunt Status:

In the Hunt Status, the master device MD will hunt for (e.g., seek) the deactivated electronic tags ET (e.g., provided that the electronic tag ET is not powered off) as depicted in the flow diagram shown in FIG. 4. Thus, in this status, if the electronic tag ET comes into the range, the master device MD will beep or the like and show that the misplaced article is in the vicinity. Preferably, the name of the electronic tag ET will also be presented on the display screen 12. Preferably, if the electronic tage is equipped with or associated with a GPS unit, it can give location information.

Off Status:

In the Off Status, the master device MD will skip the turned off the electronic tags ET and will not send probes as is depicted in the flow diagram shown in FIG. 4. Thus, in this status, if the electronic tag ET goes out of the range, the master device MD will beep or the like and will show the name of the electronic tag ET on the display 12. Also, before turning off an electronic tag ET, the user preferably has to enter a PIN number or the like to avoid accidental deactivation. Entering the PIN to turn the electronic tag ET off will send a deactivation message to the master device MD.

Other Embodiments:

According to other embodiments of this invention, articles (e.g., personal possessions) can be handed over from one person to another by making the deliverer's master device MD communicate with the recipient's master device MD (such as, e.g., over a BLUETOOTH connection or the like). Nevertheless, since it involves authorization of a master devices MD, and also handing over the electronic tags ET, in some instances this can make the scenario less user friendly. However, this may be appreciated between, e.g., family members, office environments (e.g., between employees or the like). In some examples, a handover can be done in the following two ways: The deliverer deactivates the article's electronic tag ET from his master device MD (e.g., switching the electronic tag ET Off by entering PIN) and the recipient activates the article's electronic tag ET with his master device MD (e.g., Switching master device MD to Registration Mode). This involves handing over the article along with the electronic tag ET, and making the deliverer's master device MD communicate with the recipient's master device MD (e.g., over BLUETOOTH connection) and authorize the master devices MD (this authorization could be once in life time) and authorize the transaction of the article.

In some embodiments of the present invention, the master device MD and/or the electronic tag(s) ET(s) can be equipped with a GPS to offer location based services. In other embodiments of the instant invention, beeper tones or the like can be customized for each electronic tag ET.

The master device MD can also be provisioned to send a message to a supplementary device to perform a certain function, such as, e.g., to establish a telephone call, such as, e.g., to call the local Emergency Response Agency (e.g., 911 in case of USA) in case of a theft or robbery. In some embodiments, it can also be provisioned to trigger an audio and/or video feature to start recording of the incident, and to automatically send to, e.g., a predefined Internet address of the user that could be used later for providing proof of identity of the criminal.

With reference to FIG. 4, as set forth above, FIG. 4 shows a flow diagram of an MD in an operation mode of a personal area network (PAN) for personal possessions management (PPM) according to some illustrative embodiments. In some embodiments, some or all of the functionality shown in FIG. 4 can be implemented. This functionality can be effected via programming, hardware, or firmware, as would be understood by those in the art based on this disclosure.

As shown in FIG. 4, at step 100, the master device MD is turned on. Next, at step 110, the device determines if it is in monitor mode. If the answer is no, the device follows a registration procedure at step 120, and then proceeds to step 130 to count the number N of registered electronic tags (RETs). If the answer at 110 is yes, the device proceeds to step 130 directly.

At 140, a value n is started at 1, which identifies a particular electronic tag to be checked. In the shown example, the value n can be incrementally increased at step 143 until the value of n is determined to be equal to N at step 145, in which case the process proceeds to step 140. Otherwise, if n is not equal to N, it proceeds to step 150.

At step 150, the process checks the current mode of the RET number n. In the depicted example, at step 160 the process determines if the RET number n is in an OFF Mode. If the answer is no, the process proceeds to step 160. Otherwise, if the answer is yes, it proceeds to step 155 and checks user preferences for RET number n, and displays RET number n's status at 153. Next at 260, a determination is made as to whether a secondary display is requested and/or available. If the answer is no, the system proceeds to step 270 and displays the device status on the master device, and then proceeds to step 143 to incrementally check on a next ET. If the answer at 260 is yes, the system preferably transmits information to a secondary display via, e.g., a BLUETOOTH connection or the like.

If the determination at step 160 is no, the system proceeds to step 170 and determines of the RET is in the Watch Mode. If the answer is yes, the system proceeds to step 165 and checks the user preferences for that RET number n, and at step 163 it performs (i.e., transmits) a Roll Call for that RET number n. At step 210, if the RET number n answers that Roll Call transmission, the system proceeds back to step 1 shown (i.e., and, thus, moves on to the next REF at step 143). On the other hand, if there is no answer determined at step 210, the system proceeds to set off an alarm or beeper at step 240. From this step, the system can also proceed to step 260 described above and can also proceed to a step 250 whereby results can be recorded in a user behavior log.

If the determination at step 170 is no, the system proceeds to step 180 and determines of the RET is in the Wait Mode. If the answer is yes, the system proceeds to step 175 and checks the user preferences for that RET number n, and at step 173 it checks a timer for that RET number n. At step 220, if the timer has not expired (e.g., prior to receiving a certain signal from the RET number n), the system proceeds back to step 1 shown (i.e., and, thus, moves on to the next REF at step 143). On the other hand, if the timer expires at step 220, the system proceeds to set off an alarm or beeper at step 240. From this step, the system can also proceed to step 260 described above and can also proceed to a step 250 whereby results can be recorded in a user behavior log.

If the determination at step 180 is no, the system proceeds to step 190 and determines of the RET is in the Hunt Mode. If the answer is yes, the system proceeds to step 185 and checks the user preferences for that RET number n, and at step 183 it performs (i.e., transmits) a Roll Call for that REr number n. At step 230, if the RET number n does not answer that Roll Call transmission, the system proceeds back to step 1 shown (i.e., and, thus, moves on to the next REF at step 143). On the other hand, if there is an answer determined at step 230, the system proceeds to set off a beeper at step 240. From this step, the system can also proceed to step 260 described above and can also proceed to a step 250 whereby results can be recorded in a user behavior log.

Illustrative Advantages:

One real limitation of conventional RFID readers is that they can occasionally fall to read a tag. This occurs because of interference from other objects, especially human bodies with their high water content that absorbs RF energy. IP based RFID tags can overcome this inadequacy and can provide a variety of other benefits, such as, e.g., IP based RFID tags can address Privacy and Security concerns. Since these tags are essentially computing devices, they can implement security and authentication policies. The quantity and importance of information reported from tags can increase, therefore IP based RFID tags can ensure that information is protected and only shared with authentic clients.

In addition, IP based RFID tags can be made such that they can be detected/addressed by commercially available wireless routers and bridges. Furthermore, IP based RFID tags can also provide links to the computing devices in which they are embedded. Detecting RFID tags by routers and forwarding their location and/or information to, e.g., a user's pre-configured website is also a novel and non-obvious innovative feature.

Keeping in view the future miniaturization of wireless networks and batteries (with longer operating hours) enabled by such as micro-electromechanical systems and nanotechnology, the capabilities of this technology, in terms of functionality, and applications will have noteworthy growth.

Among other things, the preferred embodiments enable a single device to be used to prevent possessions from being lost, misplaced, or being left behind accidentally or forgetfully. Moreover, the preferred embodiments allow for watching and tracking of personal possessions during movement or at rest.

Among other things, the preferred embodiments, use IP based state of art 802.11 technology coupled with Active Scanning Algorithm (see, e.g., cited references above) specifically tailored for this application.

Among other things, the preferred embodiments are capable of addressing needs of each electronic tag ET in a group individually either in a rational order or according to some preferred scheduling giving priority to those electronic tags ET that have high sensitivity (e.g., the electronic tags ET associated with more valuable or pricy possessions) according to the user preferences.

Among other things, the preferred embodiments are capable of addressing each electronic tag ET in a group individually according to a status selected by the user—such as, e.g., "Watch Status", for preventing the personal possessions from being lost, "Hunt Status", for tracking the misplaced personal possessions, and "Wait Status" for reminding a user not to forget.

Among other things, the preferred embodiments are capable of communicating and forwarding the desired information, over, e.g., a BLUETOOTH link, to authorized supplementary devices (such as, e.g., a PDA, a Cellular Phone, a lap top computer, etc.) possessed by the user to facilitate user interaction with.

In addition, the preferred embodiments offer more flexibility and keep in view future applications. As described herein, the present invention can be used to help locate or to keep track of locations of various personal items, such as, e.g., commonly needed for home or other personal use. In addition, the preferred embodiments can be used to track a variety of other items, and can be employed in office or business environments too, such as, e.g., to keep track of items within an office or group, such as, e.g., files, supplies, projects, etc. In this disclosure, the terminology personal possession includes various items that can be maintained proximate a user, including, e.g., items owned by a user for personal use, items owned by another entity maintained by the user person, items associated with non-personal environments, such as, e.g., business environments, environments in which a plurality of individuals share management or control of items, etc.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure, the following abbreviated terminology may be employed: "e.g." which means "for example."

What is claimed is:

1. A personal possession management system using a short range Internet Protocol (IP) based Personal Area Network (PAN), comprising:

a master device to be supported or held by a user; and an IP based radio frequency identification (RFID) electronic tag to be attached to or contained within a personal possession desired to be managed, the electronic tag having communicability with the master device, wherein the master device is configured to allot an IP address to the electronic tag in a registration mode using IP and to send probes to the electronic tag including the allotted IP address, wherein the electronic tag is configured to receive messages from the master device including the allotted IP address and to respond accordingly using the allotted IP address, wherein the master device alerts a user when the communicability between the master device and the electronic tag is disrupted in a monitoring mode, wherein the master device is an active, battery operated portable device capable of being carried or worn by a user, wherein the master device includes a dynamic host configuration protocol (DHCP) server that dynamically provides said IP address to the electronic tag in said registration mode using standard IEEE 802 protocols used for mobile stations and access points and said master device is configured to send said probes to the electronic tag in a monitoring mode using an active scan algorithm, wherein said master device is configured to send more frequent probes to electronic tags having higher sensitivity than to electronic tags having lower sensitivity according to user preferences, wherein said master device is configured to perform IEEE 802 authentication with the electronic tag, and wherein the master device is configured to enable a user to accept authentication rather than employing an authentication, authorization and accounting (AAA) server, and wherein the electronic tag is configured to transmit its location or other information to IP network entities other than the master device for the user of the master device.

2. The personal possession management system as recited in claim 1, wherein said standard IEEE 802 protocols include IEEE 802.11 protocols.

3. The personal possession management system as recited in claim 1, wherein the master device comprises a vibrator for warning the user when the communicability is disrupted in the monitoring mode.

4. The personal possession management system as recited in claim 1, wherein the master device comprises a beeper for warning the user when the communicability is disrupted in the monitoring mode.

5. The personal possession management system as recited in claim 1, wherein the master device has a screen for displaying a name of the electronic tag so that the name of the electronic tag displayed on the screen and coupled with the warning helps the user to take necessary actions.

6. The personal possession management system as recited in claim 1, wherein said electronic tag receives messages directly from the master device within a radio jurisdiction of the master device and responds wirelessly to the master device from within said radio jurisdiction.

7. The personal possession management system as recited in claim 1, wherein the master device further comprises a BLUETOOTH module configured to communicate with a supplemental device.

8. The personal possession management system as recited in claim 1, wherein the short range network interface comprises a receiver, a transmitter, an antenna, to carry out basic communication with the electronic tag in the registration mode and the monitoring mode.

9. The personal possession management system as recited in claim 1, wherein the electronic tag is an active, low powered battery operated device.

10. The personal possession management system as recited in claim 1, wherein the electronic tag comprises a low rate short range NLOS radio network interface for carrying out communication with the master device and a register for storing information including an IP address allocated by the master device and credentials associated to the IP address.

11. The system of claim 1, wherein the electronic tag is configured to transmit its location information to a router, bridge or computer hosting a web site.

12. The system of claim 1, wherein said electronic tag includes a global positioning system (GPS) unit and is configured to transmit its location information using messages employing the allotted IP address.

13. The system of claim 1, wherein said master device is configured to perform IEEE 802.11 authentication with the electronic tag, in which the electronic tag communicates as an 802.11 station and the master device communicates as an 802.11 access point.

14. The system of claim 13, wherein said master device is configured to perform IEEE 802.11 authentication with the electronic tag, in which the electronic tag communicates as an 802.11 station, the master device communicates as an 802.11 access point, and wherein the master device is configured to enable a user to accept authentication instead of employing an AAA server.

15. The system of claim 1, wherein the master device and the electronic device exchange configuration variables during the registration mode, and wherein after registration the master device performs an active scan of the electronic tag using Media Access Control (MAC) layer functions and with the electronic tag transmitting and receiving control and data frames.

16. The system of claim 1, wherein said electronic tag includes memory storing the IP address allocated to it and with credentials associated to it, which credentials are communicated during the registration mode.

17. A personal possession management system using a short range Internet Protocol (IP) based Personal Area Network (PAN), comprising:

a master device to be supported or held by a user; and an IP based radio frequency identification (RFID) electronic tag to be attached to or contained within a personal possession desired to be managed, the electronic tag having communicability with the master device, wherein the master device is configured to allot an IP address to the electronic tag in a registration mode using IP and sends probes to the electronic tag, wherein the electronic tag is configured to receive messages from the master device and respond accordingly, wherein the master device alerts a user when the communicability between the master device and the electronic tag is disrupted in a monitoring mode, wherein the master device comprises a short range network interface for carrying out communication with the activated electronic tag, an active register for keeping a record of active electronic tags, a legacy register for keeping a record of deactivated electronic tags, a dynamic host configuration protocol (DHCP) server for dynamically providing an IP address and configuration information to the electronic tags, an alarm to warn a user, and a user interface for facilitating user operation of the master device, wherein the electronic tag comprises a short range non line of sight (NLOS) radio network interface for carrying out communication with the master device and a register for storing information, wherein said DHCP server dynamically provides said IP address to the electronic tag in said registration mode using standard IEEE 802 protocols used for mobile stations and access points and said master device is configured to send said probes to the electronic tag in said monitoring mode using an active scan algorithm, wherein said master device is configured to send more frequent probes to electronic tags having higher sensitivity than to electronic tags having lower sensitivity according to user preferences, wherein said master device is configured to perform IEEE 802 authentication with the electronic tag, and wherein the master device is configured to enable a user to accept authentication rather than employing an authentication, authorization and accounting (AAA) server, and wherein the electronic tag is configured to transmit its location or other information to IP network entities other than the master device for the user of the master device.

18. The system of claim 17, wherein said electronic tag receives messages directly from the master device within a radio jurisdiction of the master device and responds wirelessly to the master device from within said radio jurisdiction.

19. A method of managing a personal possession using a short range Internet Protocol (IP) based Personal Area Network (PAN), the method comprising:

preparing a master device to be supported or held by a user and one or a plurality of IP based radio frequency identification (RFID) electronic tags each configured to be attached to or contained within a personal possession to be managed, each of the electronic tags having communicability with the master device;

attaching each electronic tags to a personal possession to be managed;

activating both the master device and the electronic tags;

operating the master device in a registration mode to perform registration procedures with the activated electronic tags present in a radio jurisdiction of the master device in a registration mode, the registration procedures including acquiring credential of each electronic tag and allotting an IP address to each electronic tag using a dynamic host configuration protocol (DHCP) server within the master device that dynamically provides said IP address to each electronic tag in the registration mode using standard IEEE 802 protocols used for mobile stations and access points;

monitoring said personal possessions via said master device using communications between the master device and the electronic tags employing the allotted IP addresses, further including having the master device perform a monitoring mode to perform surveillance duties governed by an Active Scanning Algorithm, wherein said monitoring mode includes said master device sending probes to the electronic tag, said master device being configured to send more frequent probes to electronic tags having higher sensitivity than to electronic tags having lower sensitivity according to user preferences, wherein said master device is configured to perform IEEE 802 authentication with the electronic tag, and wherein the master device is configured to enable a user to accept authentication rather than employing an authentication, authorization and accounting (AAA) server, and further including having the electronic tag transmit its location or other information to IP network entities other than the master device for the user of the master device.

20. The system of claim 19, wherein said electronic tags receives messages directly from the master device within a radio jurisdiction of the master device and responds wirelessly to the master device from within said radio jurisdiction.

21. A possession management system using a short range Internet Protocol (IP) based Personal Area Network (PAN), comprising:

a master device supported proximate a user; and a plurality of electronic tags supported proximate a plurality of respective possessions to be managed;

said system allotting a unique IP address to each of said electronic tag;

said master device communicating with said electronic tags by sending IP based messages to the electronic tags, and wherein the electronic tags are configured to receive said messages from the master device and transmit responses thereto using IP;

said system being configured to alert a user based on communication between the master device and an electronic tag;

wherein the master device includes a dynamic host configuration protocol (DHCP) server and said master device is configured to perform registration procedures with said electronic tags present in a radio jurisdiction of the master device in a registration mode, the registration procedures including acquiring credential of each electronic tag and allotting an IP address with said DHCP server to each electronic tag using IEEE 802.11 protocols;

wherein said master device is configured to send probes to the electronic tag in a monitoring mode using an active scan algorithm, wherein said monitoring mode includes said master device sending probes to the electronic tag, said master device being configured to send more frequent probes to electronic tags having higher sensitivity than to electronic tags having lower sensitivity according to user preferences;

wherein said master device is configured to perform IEEE 802 authentication with the electronic tag, and wherein the master device is configured to enable a user to accept authentication rather than employing an authentication, authorization and accounting (AAA) server; and wherein the electronic tag is configured to transmit its location or other information to IP network entities other than the master device for the user of the master device.

22. The system of claim 21, wherein said system is configured to alert a user based on interruption in communication between the master device and an electronic tag.

23. The system of claim 21, wherein said master device is configured to perform a hunt operation for an electronic tag.

24. The system of claim 21, wherein said master device is configured to perform a wait operation for an electronic tag.

25. The system of claim 21, wherein said master device is configured to perform a watch operation for an electronic tag.

26. The system of claim 21, wherein said master device is configured to transmit information to a secondary device for display.

* * * * *